United States Patent [19]

More

[11] 4,216,53

[45] Aug. 5, 198

[54] TRANSMITTING WELL LOGGING DATA

[75] Inventor: Henry S. More, Carmichael, Calif.

[73] Assignee: Exploration Logging, Inc., Sacramento, Calif.

[21] Appl. No.: 949,903

[22] Filed: Oct. 10, 1978

[51] Int. Cl.[2] ..... G01V 1/40; G01V 1/22

[52] U.S. Cl. ..... 367/83; 367/25; 367/40; 73/152; 324/323; 166/254; 340/856

[58] Field of Search ..... 340/18 LD, 18 NC, 15.5 BH; 175/50; 166/250, 254; 73/152

[56] References Cited

U.S. PATENT DOCUMENTS

| | | | |
|---|---|---|---|
| 2,677,790 | 5/1954 | Arps | 340/18 LD |
| 3,015,801 | 1/1962 | Kalbfell | 340/18 P |
| 3,109,693 | 11/1963 | Clements et al. | 346/109 |
| 3,205,477 | 9/1965 | Kalbfell | 340/18 P |
| 3,209,323 | 9/1965 | Grossman | 340/18 LD |
| 3,466,597 | 9/1969 | Richter et al. | 340/18 R |
| 3,559,163 | 1/1971 | Schwartz | 340/18 P |
| 3,789,355 | 1/1974 | Patton | 340/18 LD |
| 3,905,010 | 9/1975 | Fitzpatrick | 340/18 NC |
| 3,925,251 | 2/1960 | Arps | 340/18 LD |
| 3,958,217 | 5/1976 | Spinnler | 340/18 LD |
| 4,012,712 | 3/1977 | Welligan | 340/18 CM |
| 4,041,780 | 8/1977 | Angehrn | 73/152 |
| 4,047,430 | 9/1977 | Angehrn | 73/151 |
| 4,078,620 | 3/1978 | Westlake et al. | 175/48 |
| 4,087,781 | 5/1978 | Grossi et al. | 340/18 LD |
| 4,103,281 | 7/1978 | Strom et al. | 340/18 LD |

*Primary Examiner*—Nelson Moskowitz

*Attorney, Agent, or Firm*—Christie, Parker & Hale

[57] ABSTRACT

The accuracy of well logging data transmitted from downhole location to the surface of the earth is verifie by generating the data at the downhole location, storin the data in a subsurface assembly in the well, transmi ting signals corresponding to the data to the surfac through a first transmission system while keeping th data stored in the subsurface assembly, and recordin the signals transmitted to the surface through the fir transmission system. Thereafter, the subsurface assen bly is transferred to the surface, and signals correspon ing to the stored data are transmitted through a secon transmission system from the assembly to an electroni processing system. The signals transmitted through th second transmission system are then compared with th signals transmitted through the first system.

To increase the effective transmission rate of data fro the downhole location to the surface, a first set of si nals corresponding to the magnitude of a downhol condition as a function of time during a discrete tim interval are generated and transmitted through a fir transmission system to computer means at the dow hole location. The first set of signals are analyzed in th computer to determine properties of the function s lected from the group consisting of mean value, positiv and negative peak values, standard deviation value, an fundamental and harmonic frequencies and amplitude A second set of signals corresponding to the selecte values are generated and transmitted to the surfac through a second transmission system.

16 Claims, 5 Drawing Figures

TRANSMITTING WELL LOGGING DATA

BACKGROUND OF THE INVENTION

1. Field of the Invention

This invention relates to the logging of wells during drilling, and more particularly to the wireless telemetry of data relating to downhole conditions.

2. The Prior Art

It has long been the practice to log wells, that is, to sense various downhole conditions within a well and transmit the acquired data to the surface through wireline or cable-type equipment. To conduct such logging operations, drilling is stopped, and the drill string is removed from the well. Since it is costly to stop drilling operations, the advantages of logging while drilling have long been recognized. However, the lack of an acceptable telemetering system has been a major obstacle to successful logging while drilling.

Various telemetering methods have been suggested for logging while drilling. For example, it has been proposed to transmit the acquired data to the surface electrically. Such methods have in the past proved impractical because of the need to provide the drill pipe sections with a special insulated conductor and means to form appropriate connections for the conductor at the drill pipe joints. Other techniques proposed include the transmission of acoustical signals through the drill pipe. Examples of such telemetering systems are shown in U.S. Pat. Nos. 3,015,801 and 3,205,477. In those systems, an acoustic energy signal is sent up the drill pipe and frequency modulated in accordance with a sensed downhole condition. Other telemetering procedures proposed for logging while drilling use the drilling liquid within the well as the transmission medium. U.S. Pat. No. 2,925,251 discloses a system in which the flow of drilling liquid through the drill string is periodically restricted to cause positive pressure pulses to be transmitted up the column of drilling liquid to indicate a downhole condition. U.S. Pat. No. 4,078,620 discloses a system in which drilling liquid is periodically vented from the drill string interior to the annular space between the drill string and the bore hole of the well to send negative pressure pulses to the surface in a coded sequence corresponding to a sensed downhole condition. A similar system is described in the *Oil and Gas Journal,* June 12, 1978, at page 71.

Wireless systems have also been proposed using low-frequency electromagnetic radiation through the drill string, borehole casing, and earth's lithosphere to the surface of the earth.

Although the wireless transmission systems just discussed have the potential for increasing the efficiency of drilling operations to offset high operating costs, they are all subject to the disadvantages of transmitting information at a relatively slow rate compared to conventional wireline systems, and are subject to inaccuracies because of the high level of noise usually present in drilling operations.

SUMMARY OF THE INVENTION

This invention provides an improved wireless telemetering system which can be checked for reliability during drilling operations and corrected, if required. The invention also increases the amount of useful information which can be transmitted with wireless systems in a given amount of time.

This invention eliminates uncertainties which may arise from using wireless systems for telemetering downhole data to the surface of the earth. For example, in using pressure pulses transmitted through the drilling liquid, the valve which creates the pulses may become inoperative intermittently, or one or more of the jets in the drill bit may become temporarily plugged, creating a false signal or failing to generate a signal when one is required.

To verify the accuracy of data transmitted from a downhole location in a well to the surface of the earth, this invention includes the steps of generating the data at the downhole location and storing it in a subsurface assembly in the well. Signals corresponding to the stored data are transmitted to the surface through a first transmission system while keeping the data stored in the subsurface assembly. The signals transmitted to the surface through the first transmission system are recorded. Thereafter, the subsurface assembly is transferred to the surface, and signals corresponding to the stored data are transmitted through a second transmission system from the assembly to an electronic processing system, which compares the signals transmitted through the second transmission system with the signals transmitted through the first system.

In one embodiment of the invention, the first transmission system is the drilling liquid in the well, and the signals are sent to the surface by varying the flow conditions of the liquid. The second transmission system is of the "hardwire" type and not subject to the typical "noise" which can interfere with or destroy signals transmitted through the drilling liquid.

Preferably, means are provided for synchronizing the signals when they are compared. For example, a downhole clock records when the signals are stored in the subsurface assembly, and a clock at the surface records when the signals are received there. Thereafter, the times are matched to ensure synchronous comparison of appropriate signals. Thus, when the subsurface assembly is brought to the surface, say when the drill bit is to be changed, it can be interrogated to confirm the accuracy of the data sent to the surface earlier through the wireless transmission system. If there is a discrepancy, this can be analyzed to determine the source of the problem so that corrective measures can be taken immediately to improve the reliability of the wireless system during subsequent drilling.

This invention has another advantage when used in those wireless transmission systems which rely on the flow of drilling liquid either to power downhole energy supplies, such as turbine generators, or to transmit information. There are times when measurements can and should be made of a downhole condition, but if the drilling liquid is not circulating, either power is not available to operate the transmitter, or the transmissions may not be sent because the communication link is broken. However, using the storage capacity in the subsurface assembly of this invention, such data can be stored and transmitted after flow of the drilling liquid is resumed. Thus, downhole measurements made during a period when the real-time transmission link is broken can be stored and subsequently sent through the wireless transmission system when that communication link is restored. Alternatively, the logged information can be recovered from the subsurface assembly after it is raised to the surface.

One of the disadvantages of sending information to the surface with pressure pulses developed in the drilling liquid is that only a limited number of pulses can be formed in a given time, thus severely restricting the rate at which information can be transmitted. To increase the effective transmission rate of such systems, this invention includes the steps of generating a first set of electrical signals corresponding to the magnitude of a downhole condition as a function of time during a discrete time interval. The first set of signals is transmitted through a first transmission system to computer means at the downhole location. The first set of signals are analyzed in the computer to determine properties of the function selected from the group consisting of mean value, positive and negative peak values, standard deviation value, and fundamental and harmonic frequencies and amplitudes. A second set of signals are generated corresponding to the selected values and are transmitted to the surface through a second transmission system. The values represented by the second set of signals can be recombined at the surface to synthesize the original function sensed downhole.

To facilitate rapid interrogation and any desired reprogramming of the computer in the assembly in the drill string when the drill string is brought to the surface, an electrical conductor is sealed through the wall of the drill string and provided with a connector which fits in a bore extending through the drill string wall. The bore is normally closed by a cover held in place by a removable snap ring. The electrical conductor is connected to the computer in the drill string. Thus, when the subsurface electronics is brought to the surface of the earth (say to change the drill bit), it can be quickly connected to the electronic processing system at the surface of the earth by simply removing the cover over the electrical plug in the wall of the drill string and making an electrical connection while that section of the drill string stands on the derrick floor.

DESCRIPTION OF SPECIFIC EMBODIMENTS

In the preferred embodiments of the invention, as described in detail below, pressure pulses are transmitted through the drilling liquid used in normal drilling operations to send information from the vicinity of the drill bit to the surface of the earth. As the well is drilled, at least one downhole condition within the well is sensed, and a signal, usually analog, is generated to represent the sensed condition. The analog signal is converted to a digital signal, which is used to alter the flow of drilling liquid in the well to cause pulses at the surface to produce an appropriate signal representing the sensed downhole condition.

Figure 1:
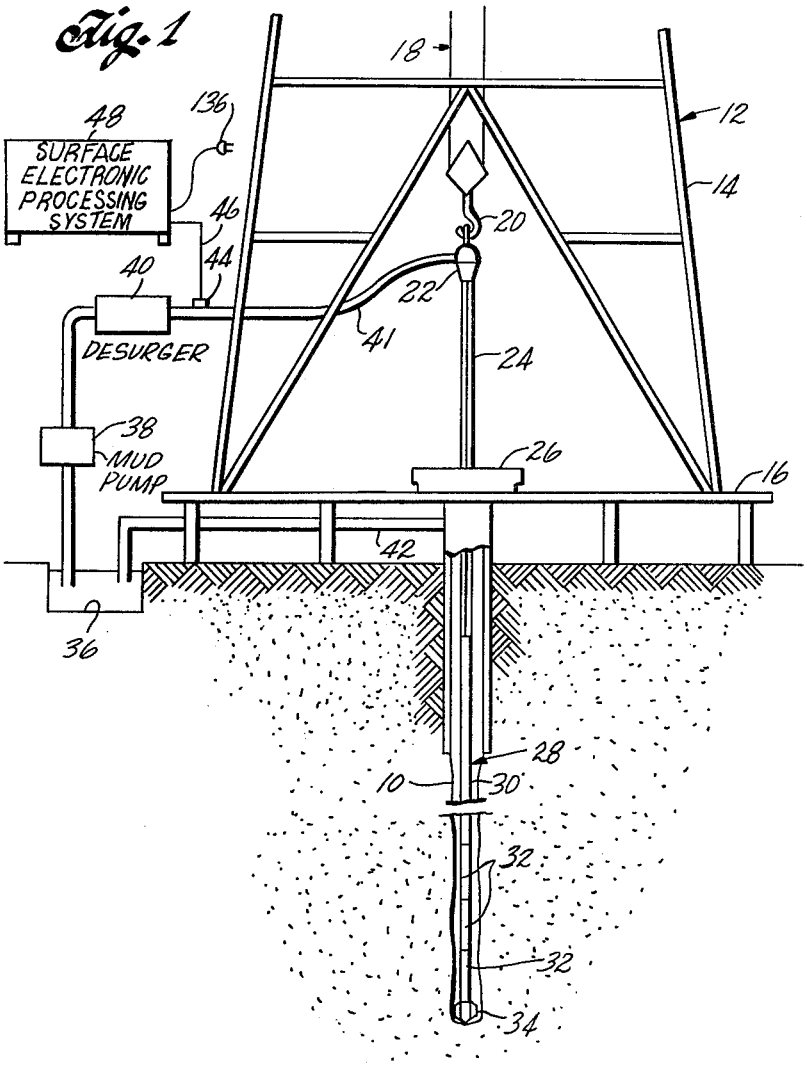
FIG. 1 shows a system for simultaneously drilling and logging a well.

Referring to FIG. 1, a well 10 is drilled in the earth with a rotary drilling rig 12, which includes the usual derrick 14, derrick floor 16, draw works 18, hook 20, swivel 22, kelly joint 24, rotary table 26, and drill string 28 that includes conventional drill pipe 30 secured to the lower end of the kelly joint 24 and to the upper end of a section of drill collars 32, which carry a drill bit 34. Drilling liquid (or mud, as it is commonly called in the field) is circulated from a mud pit 36 through a mud pump 38, a desurger 40, a mud supply line 41, and into the swivel 22. The drilling mud flows down through the kelly joint, drill string and drill collars, and through jets (not shown) in the lower face of the drill bit. The drilling mud flows back up through the annular space between the outer diameter of the drill string and the well bore to the surface where it is returned to the mud pit through a mud return line 42. The usual shaker screen for separating formation cuttings from the drilling mud before it returns to the mud pit is not shown.

Figure 3:
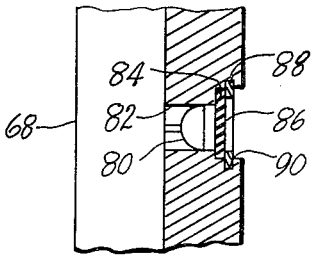
FIG. 3 is an enlarged view taken within the area 3 of FIG. 2.

A transducer 44 is mounted in mud supply line 41 to detect variations in drilling mud pressure at the surface. The transducer generates electrical signals responsive to drilling mud pressure variations, and these signals are transmitted by an electrical conductor 46 to a surface electronic processing system 48, the operation of which is described below in detail with respect to FIG. 3.

Figure 2:
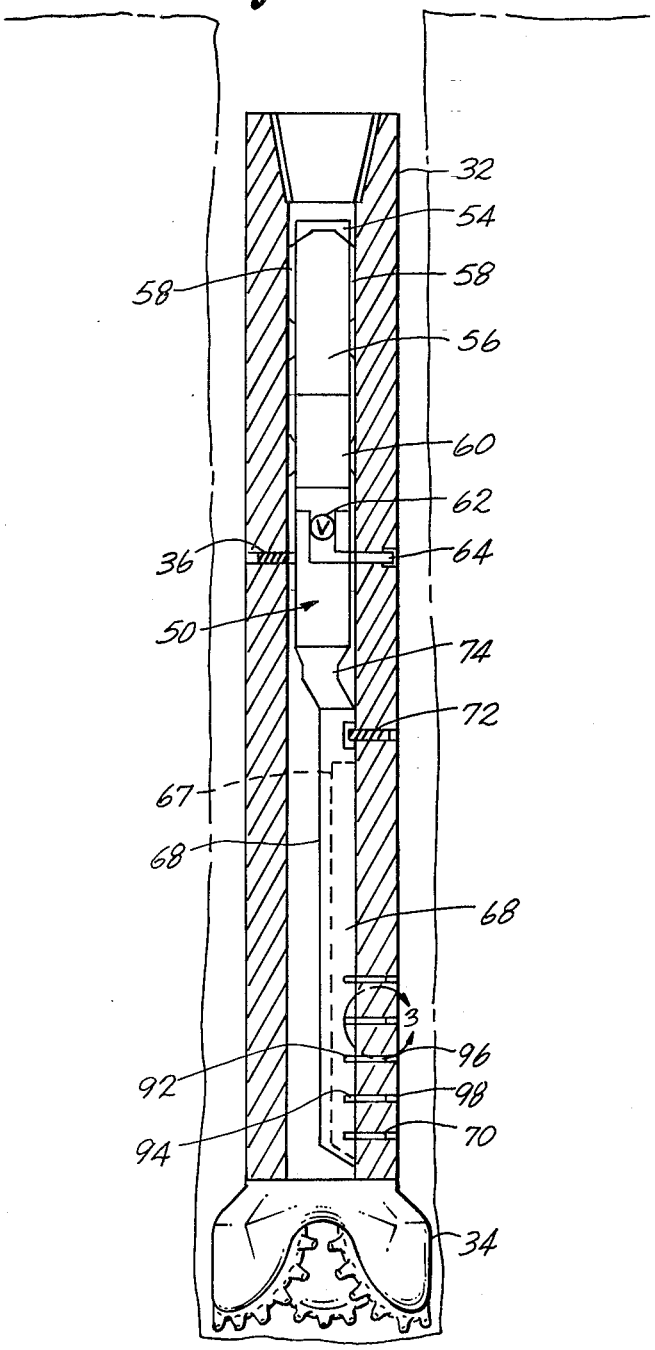
FIG. 2 is a longitudinal cross-section of the logging portion of the drill string.

Referring to FIG. 2, a logging tool 50 is located within the drill collar nearest the drill bit. The logging tool includes one or more logging transducers for sensing downhole conditions, and a pressure pulse generator for imparting pressure pulses to the drilling liquid. Ordinarily, the logging tool is provided wih transducers to measure a number of downhole conditions, such as natural gamma ray count of the earth formations, torque at the bit, weight on the bit, drilling liquid pressure inside and outside the drill string, electrical resistivity of the drilling liquid inside and outside the drill string, temperature of the drilling liquid inside and outside of the drilling string, electrical resistivity of the adjacent earth formation, inclination and azimuth of the well bore, tool face bearing, tool temperature, drill bit rpm, and drilling liquid flow rate.

As shown best in FIG. 2, the logging tool 50 includes a mud turbine 54 for extracting some energy from the flowing drilling liquid and a generator 56 for converting the rotational energy of the turbine 54 into electrical energy to supply the power needs of the subsurface components in the logging tool. The turbine and generator are stabilized inside the drill collar by conventional wings or spiders 58. A mud pulser 60 is supplied power from the generator and is designed to release drilling liquid from inside the drill collar to the annular space between the drill collar o.d. and well bore on command. This is accomplished by changing the state of a pulser valve 62 to allow drilling liquid to vent through an orifice 64 extending through the drill collar wall. Thus, when the valve is opened, a portion of the drilling liquid is bypassed around the pressure drop normally imposed on the flowing drilling liquid by the jets (not shown) in the drill bit. This causes the mud pressure at the surface to decrease below its normal operating value. When the valve is closed, the drilling liquid pressure at the surface is restored to its normal condition. Thus, opening and closing the valve creates a negative pressure pulse at the surface. The pulsing valve and its associated driving equipment may be of any suitable type which will cause a pressure pulse in the drilling liquid of sufficient amplitude for detection at the surface. A suitable mud pulsing valve for use in carrying out the present invention is disclosed in the *Oil and Gas Journal* of June 12, 1978, on page 71. Another system which may be used for generating pressure pulses in drilling fluid is shown in U.S. Pat. No. 4,078,620. If positive pulsing is desired, the pulser unit may be of the type disclosed in U.S. Pat. Nos. 2,925,251 or 3,958,217. The turbine, generator, and pulser valve are stabilized concentrically inside the drill collar by the wings or spiders 58 and are secured from moving axially and rotationally by a bolt 66 threaded through the drill collar wall to fit into a threaded opening (not shown) in the portion of the logging tool which houses the pulser valve.

A subsurface electronic system 67 for processing and storing data is mounted in a pressure barrel 68, which is bolted against the inside wall of the drill collar by a securing bolt 70 and an axially-floating bolt 72, which prevents axial strain in the pressure barrel transferred to the barrel from the drill collar. Mechanical and electrical connections are made from the pressure barrel to the pulser valve unit by a transition piece 74, which allows a concentric to eccentric connection.

Electrical connection to the subsurface electronic system when the logging tool is brought to the surface of the earth can be quickly made through an electrical connector 80 mounted in a stepped bore 82 (FIG. 3) extending through the drill collar wall. The bore 82 is of increased diameter at its outer end to form an outwardly-facing shoulder 84, which receives a disc or cover 86 held in place by a C-shaped snap ring 88 mounted in an inwardly-facing annular groove 90 in the larger portion of the stepped bore 82. The cover protects the electrical connection when the logging tool is downhole. When the logging tool is physically accessible and not submerged in drilling fluid, the snap ring and cover may be removed to allow quick connection to the electrical connector 80.

Bores 92 and 94 are also provided through the drill collar wall for the mounting of transducers 96 and 98 to measure various downhole conditions exterior of the drill string. Other transducers (not shown) are mounted within the drilling string for sensing internal conditions. Such transducers are well known to those skilled in the art.

Figure 4:
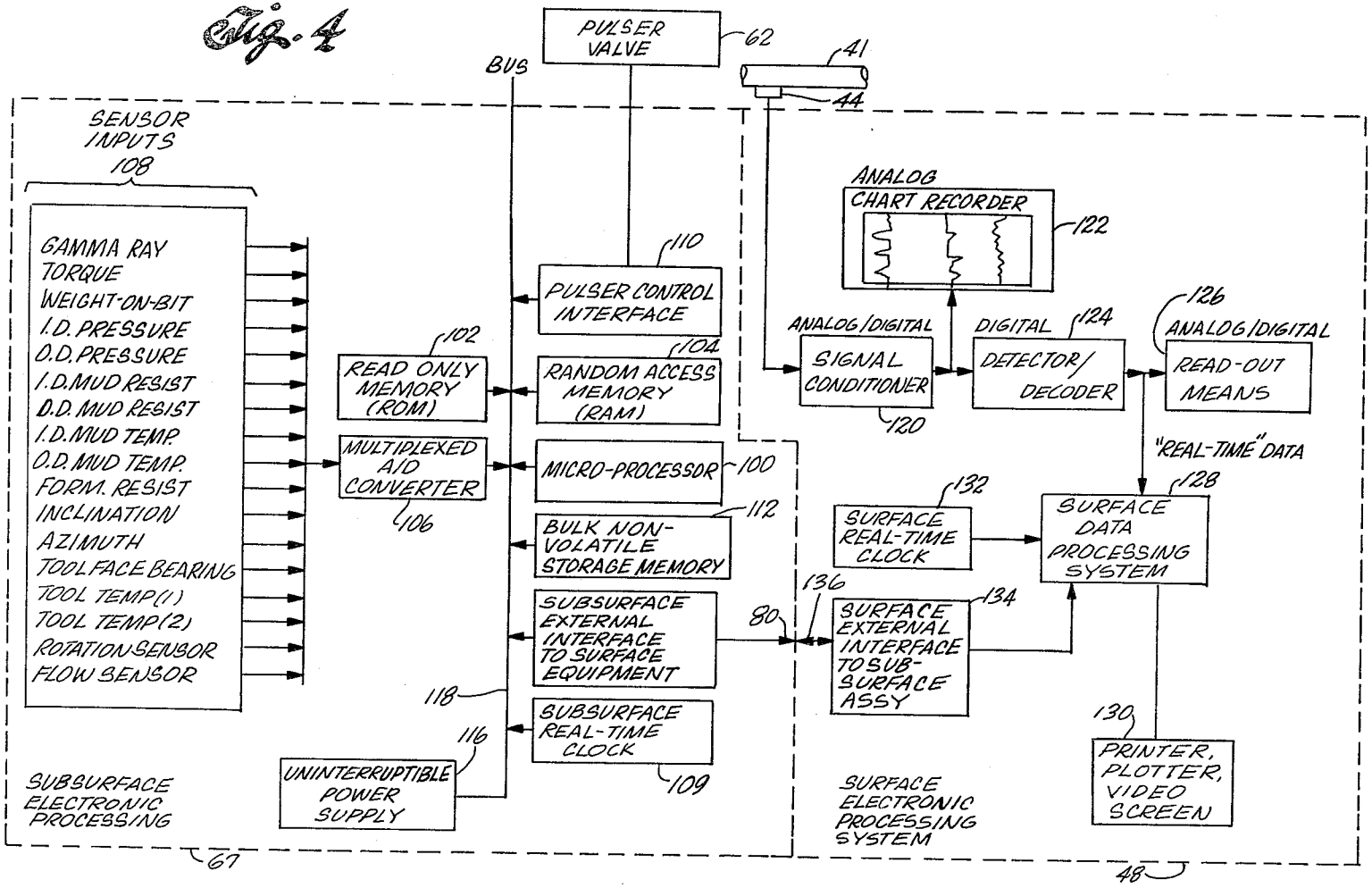
FIG. 4 is a schematic block diagram of the downhole electronic processing system and of the surface electronic processing system.

Referring to FIG. 4, the subsurface electronic system in the pressure barrel includes a conventional microprocessor 100, which performs functions and makes decisions and computations according to a predetermined sequence controlled by a computer program maintained in a read only memory (ROM) 102 to aid the microprocessor in its operation. An erasable random access memory (RAM) 104 is provided to serve as a "scratch pad" memory. The microprocessor is required by the computer program to take certain measurements by connecting specific sensor inputs from the transducers, which detect various downhole conditions, to a multiplexed analog/digital converter 106. Typical sensor inputs are shown under reference numeral 108. The microprocessor is also connected to a subsurface real-time clock 109, which allows the microprocessor to perform its functions in relation to time. The microprocessor is also connected to a pulser control interface 110, which allows the microprocessor to control the operation of the pulser valve 61 (FIG. 2). The microprocessor is also connected to a bulk non-volatile storage memory 112 and to a subsurface external interface 114, the output of which is connected to electrical connector 80 for quick communication with the surface electronic processing system 48. This communication can be effected only when the subsurface assembly is physically accessible and not submerged in the drilling liquid. The signals stored in the non-volatile storage memory are correlated with time by the subsurfac real-time clock.

Electrical power is supplied by an uninterruptabl power supply 116 connected to a bus 118, whic supplies power to and interconnects the microproces sor, the random access memory, the read only memory the multiplexed analog/digital converter, real-tim clock, the pulse control interface, the bulk non-volatil storage memory, and the subsurface external interface The power supply 116 includes batteries (not shown) s the logging tool can continue to sense downhole condi tions and store them in the bulk non-volatile memory even when the flow of drilling liquid is stopped.

Still referring to FIG. 4, which also shows the pre sently-preferred embodiment of the surface electroni processing system, the transducer 44 in the mud suppl line 41 detects the disturbances in the drilling liqui system caused by the operation of the pulser valve Such disturbances are thus transduced into one or mor electrical voltage or current signals, which are fe through the conductor 46 to a signal conditioner 120 which permits operations, such as buffering, filtering and calibrating, to be performed on the incoming signal To keep a permanent visible record of the conditione pressure signals, a strip-chart recorder 122 is connecte to the output of the signal conditioner. That output i also connected to the input of a detector/decoder as sembly 124, which extracts the digital information fron the conditioned signals and decodes from this the down hole values being transmitted from the well borehole An analog/digital readout means 126 is connected t the output of the detector/decoder, and it is used t display that information if desired. In addition, the real time signals corresponding to the value of the sense downhole conditions are fed into a surface data process ing system 128, which includes a conventional mini computer, storage memory, program control (keyboar and video screen), and means for entering operatin computer programs. The output of the surface dat process system is connected to a display 130, such as printer, plotter, or video screen. A surface real-tim clock 132 is connected to the surface data processin system for time-dependent functions and for correlatin data retrieved from the subsurface assembly when it i in an accessible location. This data retrieval is per formed by a surface external interface 134, which has plug 136 adapted to make a quick connection with elec trical connector 80 when the logging tool subsurfac assembly is brought to the derrick floor.

Figure 5:
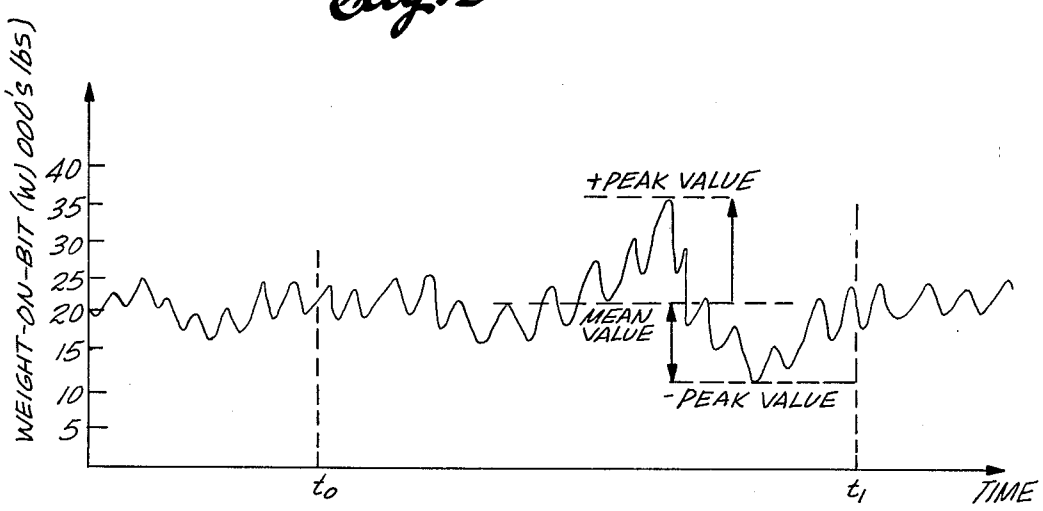
FIG. 5 is a plot of weight on the bit during a typical drilling operation.

The practice of the invention will be explained wit reference to sensing and transmitting to the surfac signals corresponding to weight-on-bit measurement during a typical drilling operation in which drillin liquid is circulated down through the drill string around the logging tool in the drill collar, and the dril bit, and back to the surface while the drill string and bi are rotated to drill the well. FIG. 5 shows how th weight on the drilling bit may vary as a function wit respect to time. To avoid overloading the wireles transmission system used in this invention, the instanta neous signals generated by the transducer which sense the weight on the bit are passed through the multi plexed a/d converter and fed into the microprocessor which is programmed to analyze the signals over a finit time period, $t_0$ to $t_1$, say 5 minutes. During this inverval the signals representing the weight on the bit are pro cessed to derive the mean value, positive and negativ peak values, standard deviation information, and funda mental and harmonic frequencies and amplitudes. The frequencies are determined with relative magnitudes by any suitable method, such as performing a Fast Fourier Transform on the sampled wave form. The derived values are stored in the bulk non-volatile storage memory and are also used to generate signals which are fed through the pulser control interface to operate the pulser valve in a binary coded sequence to create pressure pulses in the flowing drilling liquid which correspond to the derived values. The pulses are detected at the surface in the mud supply line 41 by the transducer 44, which feeds the developed electrical signals through the signal conditioner, the detector/decoder, and the readout means, which presents the downhole information for immediate interpretation and action. The pulses are recorded on the chart recorder, and the electrical signals from the detector/decoder are fed into the surface data processing system, where they are correlated with time by the surface real-time clock. The signals are stored in the surface data processing system and may be displayed when desired by feeding the output of the surface data processing system to the display 130, which prints, plots, or shows the data on a video screen.

Since the most important features of the downhole wave form are known at the surface, a replica of that wave form can be constructed from the selected values, if desired, or that information can be used with other information derived at the surface to compute formation drillability and other values of importance to the drilling operation. Thus, by performing the downhole anaylses of the signals received from the transducer sensing the downhole condition, it is possible to deliver the most significant information through the wireless transmission system in a relatively short time.

In a similar way, the other downhole conditions can be sensed, processed, and transmitted to the surface by the operation of the multiplexed a/d converter, the operation of which is well-understood by those skilled in the art.

When the drill string must be removed from the well, say to change the drill bit, the logging tool and the subsurface assembly within it are temporarily available at the surface. During this relatively brief interval, the cover is removed from the bore in which electrical connection 80 is mounted. Surface plug 136 is quickly connected to the electrical connector 80 to permit all of the information stored in the bulk non-volatile storage memory to be transmitted through the subsurface external interface and the surface external interface to the surface data processing system, where the data recorded through the "hardwire" subsurface system can be compared with that transmitted through the wireless system. Any errors which occur can then be detected, because the signals are synchronized by the surface and subsurface real-time clocks. In this way, the percentage of mistransmissions can be computed after each drill bit run and correlated with mud and well conditions to provide for more accurate prediction of transmission accuracies for different conditions during future drill bit runs. Moreover, if there are errors, steps can be taken to eliminate the cause of them. For example, if the pulser valve is intermittently inoperative, it can be repaired or replaced. Alternatively, if some drilling condition creates interfering noise, that can be modified to eliminate the source of error.

During those periods of the drilling operation when circulation of the drilling liquid is interrupted, say when drill string is being added or removed at the surface, downhole logging can continue and be stored in the bulk non-volatile storage memory for immediate recall once the circulation of the drilling liquid is resumed. This is particularly useful in measuring downhole conditions, such as temperature, which should be monitored even though drilling operations have momentarily ceased. Thus, by measuring the rise of temperature of the drilling liquid surrounding the drill bit during static conditions, an accurate estimate can be made of the adjacent formation temperature.

When the drill string is being withdrawn from the well, the pressure pulsing system is necessarily inoperative, because circulation of the drilling liquid is stopped. Even so, certain downhole conditions can be sensed and stored in the bulk non-volatile storage memory for recall once the logging tool is brought to the surface. For example, formation electrical resistivity may be of one value during the early stages of the drilling operation, and change significantly due to mud filtrate penetration as drilling continues. By logging formation electrical resistivity when the formation is first drilled, and then later, as the drill bit is withdrawn, valuable information concerning formation porosity and permeability can be obtained.

I claim:

1. A method for verifying data transmitted from a downhole location in a well to the surface of the earth, the method comprising the steps of:
   - generating the data at the downhole location;
   - storing the data in a subsurface assembly in the well;
   - transmitting signals corresponding to the data to the surface through a first transmission system while keeping the data stored in the subsurface assembly;
   - recording the signals transmitted to the surface through the first transmission system;
   - thereafter transferring the subsurface assembly to the surface;
   - transmitting signals corresponding to the stored data through a second transmission system from the assembly to an electronic processing system; and
   - comparing the signals transmitted through the second transmission system with the signals transmitted through the first system.

2. A method according to claim 1 in which the first transmission system includes the step of creating pressure pulses in a drilling liquid in the well.

3. A method according to claim 1 which includes means for recording the time at which signals are received at the surface, and means in the subsurface assembly for recording the time when corresponding signals are stored in the subsurface assembly.

4. A method according to claim 1 which includes means for synchronizing the signals transmitted through the second transmission system with the signals transmitted through the first system.

5. A method for transmitting data from a downhole location in a well to the surface of the earth, the method comprising the steps of:
   - circulating a drilling liquid through the well;
   - stopping the circulation of the drilling liquid through the well;
   - generating the data at the downhole location while circulation of the drilling liquid is stopped;
   - storing the data in a subsurface assembly in the well while the circulation of the drilling liquid is stopped;
   - resuming the circulation of the drilling liquid in the well; and thereafter transmitting signals corresponding to the data stored in the subsurface assembly through the drilling liquid by altering the rate of flow of the drilling liquid through the well in a coded sequence corresponding to the signals.

6. A method according to claim 5 which includes the step of transferring the subsurface assembly to the surface after the signals are transferred through the drilling liquid, and comparing the data stored in the subsurface assembly with the signals transmitted to the surface through the drilling liquid.

7. A method of increasing the effective transmission rate of data from a downhole location in a well to the surface, the method comprising the steps of:

generating a first set of electrical signals corresponding to the magnitude of a downhole condition as a function of time during a discrete time interval;

transmitting the first set of signals through a first transmission system to computer means at the downhole location;

analyzing the first set of signals in the computer to determine properties of the function selected from the group consisting of mean value, positive and negative peak values, standard deviation value, and fundamental and harmonic frequencies and amplitudes;

generating a second set of signals corresponding to the selected values; and transmitting the second set of signals to the surface through a second transmission system.

8. A method according to claim 7 in which the second transmission system includes the step of transmitting pressure pulses through a drilling liquid in the well.

9. A method according to claim 7 which includes the step of storing the second set of signals in a subsurface assembly, retrieving the subsurface assembly, and thereafter comparing the stored signals with the second set of signals transmitted through the second transmission system.

10. A method according to claim 7 which includes the step of combining the selected values transmitted to the surface to approximate the wave form of the downhole condition developed during the said discrete time interval.

11. In a well drilling rig which includes a hollow drill string within a well, a rotatable drill bit on the lower end of the drill string, and means for circulating drilling liquid through the drill string and well, the improvement comprising:

a subsurface assembly installed within the drill string;

at least one transducer for sensing a downhole condition;

electronic means in the assembly and connected to the transducer for generating a first set of signals corresponding to the magnitude of the downhole condition;

a first transmission means for sending the first set of signals to the surface;

means at the surface for recording the first signals;

an electronic memory system in the assembly;

means for transmitting the first set of signals to the memory through a second transmission means different from the first;

means for retrieving the subsurface assembly from the well;

means for generating a second set of signals corresponding to the first signals stored in the memory; and means for comparing the second signals with the first signals received at the surface through the first transmission means.

12. Apparatus according to claim 11 which includes means for synchronizing the two sets of signals.

13. Apparatus according to claim 11 which includes a downhole clock means for recording the real-time when the first set of signals are generated downhole, and a second clock means for recording the real-time when the first set of signals are received at the surface.

14. In a well drilling rig which includes a hollow drill string within a well, a rotatable bit on the lower end of the drill string, and means for circulating drilling liquid through the drill string well, the improvement comprising:

a subsurface assembly installed within the drill string;

a transducer for sensing a downhole condition;

electronic means in the assembly and connected to the transducer for generating a first set of signals corresponding to the magnitude of the downhole condition;

computer means in the assembly to receive the first set of signals and generate a second set of signals corresponding to properties of the downhole condition selected from the group consisting of mean value, positive and negative peak values, standard deviation value, and fundamental and harmonic frequencies and amplitudes;

first transmission means for transmitting the first set of signals to the computer means; and second transmission means for transmitting the second set of signals from the computer means to the surface.

15. Well logging apparatus comprising:

an elongated hollow drill string section adapted to fit in a well, the drill string section having an annular wall;

computer means mounted in the section;

an information-responsive transducer connected to the computer means for sensing downhole information and storing the information in the computer means; and an electrical conductor connected to the computer means and extending through the wall of the section to permit rapid electrical access to the computer means when the section is out of the well.

16. Apparatus according to claim 15 which includes an electrical connector mounted in a bore extending through the wall of the drill string section, a cover mounted in the bore external of the electrical connector, and means for temporarily securing the cover in place.

* * * * *

UNITED STATES PATENT AND TRADEMARK OFFICE

CERTIFICATE OF CORRECTION

PATENT NO. : 4,216,536

DATED : August 5, 1980

INVENTOR(S) : Henry S. More

It is certified that error appears in the above-identified patent and that said Letters Patent are hereby corrected as shown below:

[56] References Cited - "3,925,251" should read --2,925,251--

Col. 5, line 60, "61" should read --62--

Col. 7, line 31, "anaylses" should read --analyses--

Signed and Sealed this

Third Day of February 1981

[SEAL]

Attest:

RENE D. TEGTMEYER

Attesting Officer

Acting Commissioner of Patents and Trademarks